US008197268B2

(12) United States Patent
Tsugaru et al.

(10) Patent No.: US 8,197,268 B2
(45) Date of Patent: Jun. 12, 2012

(54) ELECTRONIC DEVICE HAVING AN INTERFACE CONNECTOR WITH POWER SUPPLY COVERING ANOTHER POWER SUPPLY CONNECTOR

(75) Inventors: Hiroyuki Tsugaru, Tokorozawa (JP); Katsutoshi Mukaijima, Higashikurume (JP)

(73) Assignees: Citizen Holdings Co., Ltd., Tokyo (JP); Citizen Systems Japan Co., Ltd., Tokyo (JP)

( * ) Notice: Subject to any disclaimer, the term of this patent is extended or adjusted under 35 U.S.C. 154(b) by 0 days.

(21) Appl. No.: 12/985,863

(22) Filed: Jan. 6, 2011

(65) Prior Publication Data

US 2011/0173364 A1 Jul. 14, 2011

(30) Foreign Application Priority Data

Jan. 8, 2010 (JP) ..... 2010-003375

(51) Int. Cl.
*H01R 13/44* (2006.01)

(52) U.S. Cl. ..... 439/131

(58) Field of Classification Search ..... 439/131–149, 439/367

See application file for complete search history.

(56) References Cited

U.S. PATENT DOCUMENTS

| | | | | |
|---|---|---|---|---|
| 6,095,867 | A * | 8/2000 | Brandt et al. | 439/620.09 |
| 6,179,644 | B1 * | 1/2001 | Adams et al. | 439/387 |
| 6,365,990 | B2 * | 4/2002 | Flegel | 307/64 |
| 7,037,121 | B1 * | 5/2006 | Gray, Jr. | 439/135 |
| 7,488,178 | B2 * | 2/2009 | Inotsuka | 439/15 |
| 7,997,925 | B2 * | 8/2011 | Lam et al. | 439/535 |
| 2010/0029109 | A1 * | 2/2010 | Lam et al. | 439/136 |
| 2010/0240238 | A1 * | 9/2010 | Hattori et al. | 439/135 |

FOREIGN PATENT DOCUMENTS

| | | |
|---|---|---|
| JP | 03-015319 Y2 | 2/1985 |
| JP | 2009-224088 A | 10/2009 |

* cited by examiner

*Primary Examiner* — Chandrika Prasad
(74) *Attorney, Agent, or Firm* — Sughrue Mion, PLLC

(57) ABSTRACT

An electronic device includes a first opening disposed in a casing; a power source connector disposed opposing the first opening and to which a detachable power supply plug that supplies power from a power supply unit is attached; a second opening disposed in the casing; and a support member by which at least one interface connector among various types of interface connectors for communication with an external apparatus can be attached at the second opening, where the support member covers and hides the power source connector if among the various types of interface connectors, an interface connector having a power supply terminal is attached.

2 Claims, 5 Drawing Sheets

ELECTRONIC DEVICE HAVING AN INTERFACE CONNECTOR WITH POWER SUPPLY COVERING ANOTHER POWER SUPPLY CONNECTOR

BACKGROUND OF THE INVENTION

1. Field of the Invention

The present invention relates to an electronic device having multiple power supply systems.

2. Description of the Related Art

Conventionally, there are electronic devices that operate using power (power source) from a power supply unit such as an AC power source. Such electronic devices have a power source connector to which a power supply plug is connected. The power supply plug is provided on a cable for connecting the power supply apparatus to the electronic device.

Among such conventional electronic devices equipped with a power source connector is an electronic device that operates using power supplied from an external apparatus, such as host computer. The power is supplied through an interface for exchanging data with the external apparatus and the interface is implemented by, for example, a versatile USB, an IEEE1394 compliant connector, and the like.

Electronic devices that operate using power supplied from an external apparatus are equipped with a power source connector as a standard and may be optionally equipped with an interface connector having a power supply terminal. In addition to a power source connector, such electronic devices are equipped with an interface connector having a power supply terminal.

For example, according to a technique disclosed in Japanese Utility Model Publication No. H03-15319, a first interface is disposed on a motherboard, while a second interface for a data reception scheme different from that of the motherboard is disposed on a sub-board together with a member covering the terminal of the first interface connector. The first interface connector electrically connects the sub-board to the motherboard.

Further, according to a technique, for example, disclosed in Japanese Patent Application Laid-Open Publication No. 2009-224088, openings are disposed at various aspects of the casing of an electronic device. Terminals are disposed opposing each of the openings, among which, one opening is opened while the other openings are blocked by a blocking unit.

Since the conventional arts above dispose, in addition to a power source connector, an interface connector having a power supply terminal and continuously maintain a state in which the power supply plug can be connected to the power source connector, a situation occurs where the power supply plug is connected to the power source connector in a state where a plug is connected to the interface connector having the power supply terminal.

In this state, for example, if the power supplied through the power connector is greater than that supplied from the interface connector having the power supply terminal, the excess power flows back to the external apparatus connected via the interface connector and data stored in the external apparatus, apparatuses connected to the external apparatus or the apparatus itself is may be damaged.

Since the technique recited in Japanese Utility Model Publication No. H03-15319 separately disposes on the sub-board, a member covering the terminal of the first interface, a problem arises in that the number of components increases. Further, since the blocking units of the technique recited in Japanese Patent Application Laid-Open Publication No. 2009-224088 are independent components, the problem of increased components arises and because the blocking units are moveable, space for the blocking units to move has to be established, increasing the size of the electronic device.

SUMMARY OF THE INVENTION

An electronic device according to one aspect of the present invention includes a first opening disposed in a casing; a power source connector disposed opposing the first opening and to which a detachable power supply plug that supplies power from a power supply unit is attached; a second opening disposed in the casing; and a support member by which at least one interface connector among various types of interface connectors for communication with an external apparatus can be attached at the second opening, where the support member covers and hides the power source connector if among the various types of interface connectors, an interface connector having a power supply terminal is attached.

DETAILED DESCRIPTION OF THE PREFERRED EMBODIMENTS

Referring to the accompanying drawings, exemplary embodiments according to the present invention are explained in detail below.

Figure 1:
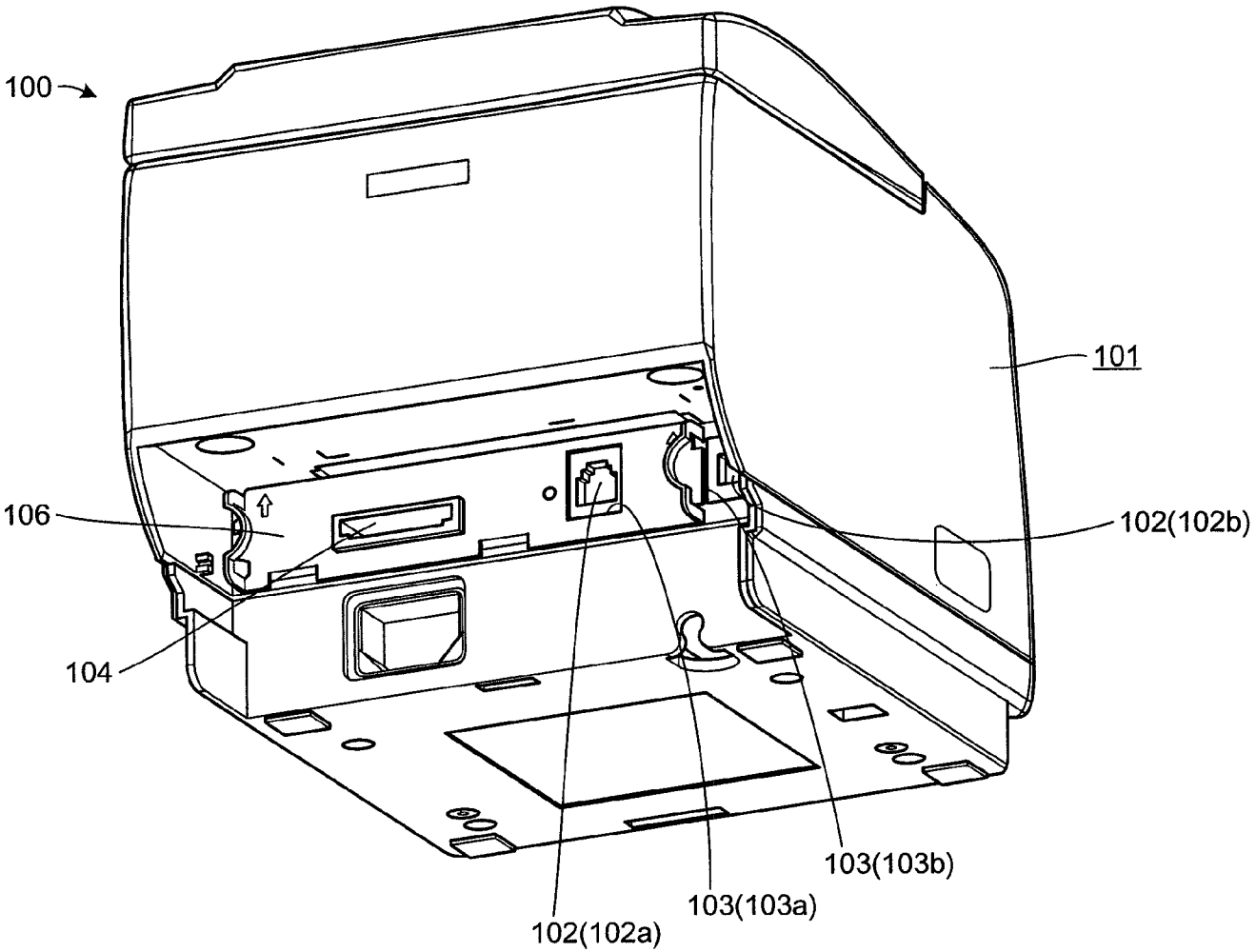
FIG. 1 is a schematic depicting a configuration of an electronic device according to the present invention.

FIG. 1 is a schematic depicting a configuration of an electronic device according to the present invention. FIG. 1 depicts a perspective view of an electronic device according to an embodiment of the present invention as viewed from lower aspect.

As depicted in FIG. 1, an electronic device 100 according to the embodiment includes a casing 101. The casing 101 is substantially a six-sided figure having front, back, left, right, top, and bottom surfaces (cube). The main unit (not depicted) of the electronic device 100 is disposed inside the casing 101.

The main unit of the electronic device 100 includes a control unit that controls each component of the electronic device 100. The control unit can be implemented by a microcomputer configured by a CPU, memory such as a ROM and RAM, etc. The microcomputer and control of the electronic device 100 by a microcomputer configured by a CPU, memory, etc. can be easily implemented using various conventionally known arts and description thereof is omitted.

The main unit of the electronic device 100 includes communication interface connectors (communication connectors) 102 (102*a*, 102*b*) for receiving and transmitting commands, data, etc. with respect to an external apparatus (not depicted). Openings 103 (103*a*, 103*b*) are disposed respectively at positions corresponding to the communication connectors 102 (102*a*, 102*b*), such that plugs can be connected to and disconnected from the communication connectors 102 (102*a*, 102*b*) through the openings 103 (103*a*, 103*b*).

The CPU of the main unit of the electronic device 100, based on commands, data, etc. received via the communication connectors 102 (102*a*, 102*b*), controls each of the components of the electronic device 100 by using the RAM as a work area to execute various programs stored on the ROM.

Further, the CPU can output to an external apparatus via the communication connectors 102 (102*a*, 102*b*), data obtained as a result of the execution of the programs.

The electronic device 100 includes a power source connector (see reference numeral 201 in FIG. 2) to which a detachable power supply plug (not depicted) that supplies power from a power supply unit is attached. The power supply plug can be connected to and disconnected from the power supply connector 201 via a first opening (see reference numeral 202 in FIG. 2) disposed in the casing 101. The power source connector is disposed opposing the first opening. The electronic device 100 operates as a self-powered device by using power supplied from the power supply unit (not depicted) via the power supply plug attached to the power source connector 201.

The electronic device 100 includes an interface connector 104. The interface connector 104 is used when the electronic device 100 communicates with an external apparatus. Various commonly known interface connectors, such as an interface connector having a power supply terminal, can be used as the interface connector 104. The interface connector 104 is supported by a support member 106.

If, for example, the electronic device 100 is a bus-powered device, the interface connector 104 can be implemented by an interface connector that enables bus-powered operation of the electronic device 100. Specifically, for example, the interface connector 104 can be implemented by a connector compliant with PoweredUSB standards.

Implementation of the interface connector 104 by a connector compliant with PoweredUSB standards enables greater power (e.g., 12V, 24V, etc.) to be supplied to the electronic device 100 as compared to a versatile USB, an IEEE1394 compliant connector, and the like.

Bus-powered devices offer the advantage of enabling a simplification of wiring. Meanwhile, the power that can be supplied via a versatile USB, an IEEE1394 compliant connector, and the like is limited. For example, if the electronic device 100 is a printer apparatus connected to a point of sales (POS) terminal apparatus serving as a host computer, situations can be expected where greater power is temporarily required, such as when receipts and journals are to be printed in parallel.

If the electronic device 100 is in an operation environment where power supplied via a versatile USB, an IEEE1394 compliant connector, and the like is used, failures in which the electronic device ceases to operate due to insufficient power can be expected in the situation described above. Thus, by implementing the interface connector 104 by a connector compliant with PoweredUSB standards, wiring can be simplified without the occurrence of electronic device failure due to insufficient power.

Figure 2:
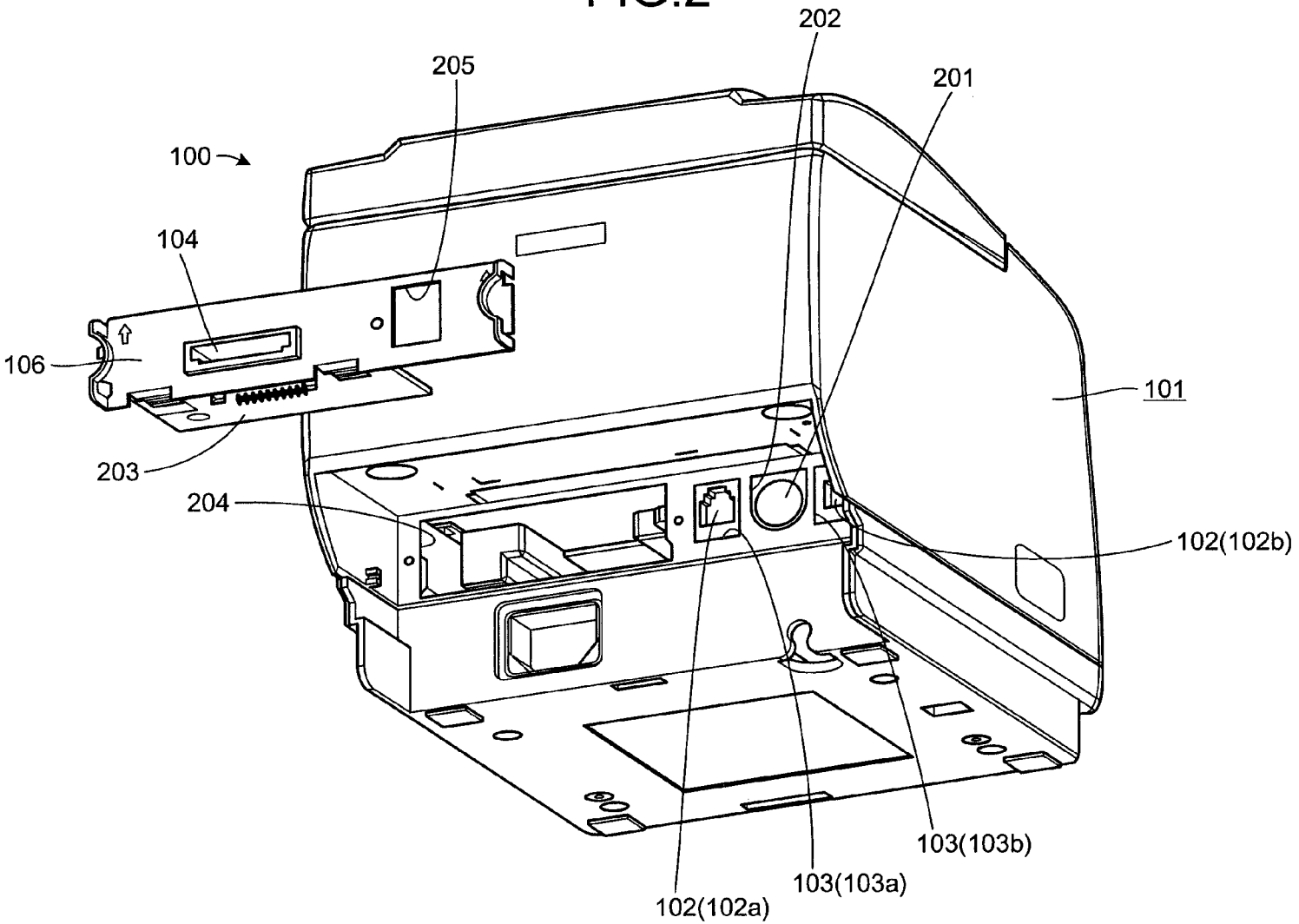
FIGS. 2 and 3 are schematics depicting a configuration of the electronic device according to the present invention.
Figure 3:
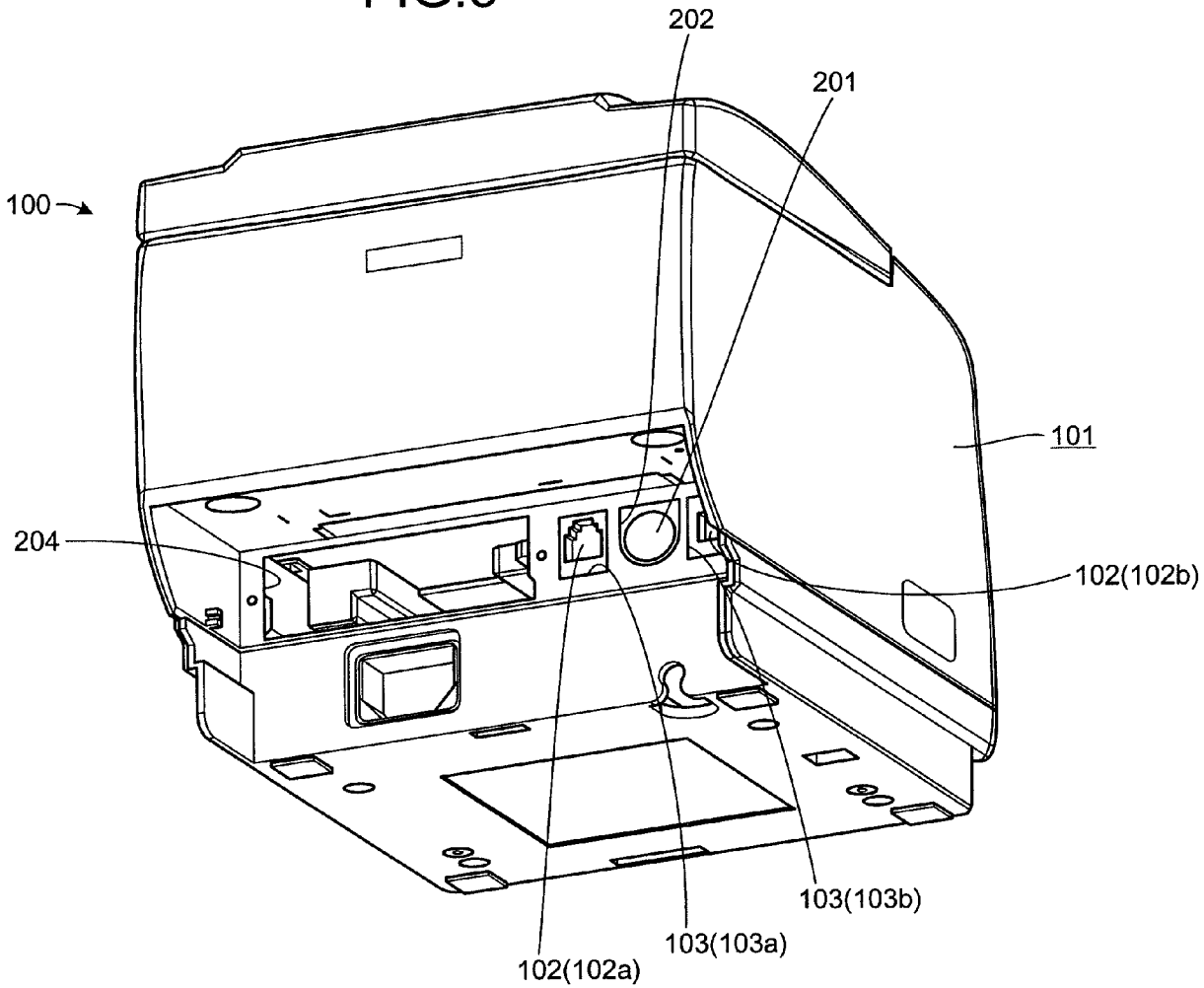

FIGS. 2 and 3 are schematics depicting a configuration of the electronic device 100. FIGS. 2 and 3 are perspective views of the electronic device 100 as viewed from a lower aspect and depict a state where the interface connector 104 has been removed from the main unit of the electronic device 100.

As depicted in FIGS. 2 and 3, the interface connector 104 is detachable from the main unit of the electronic device 100. The interface connector 104 is attached to the main unit of the electronic device 100, if for example, an external device, such as a host computer connected to the electronic device 100, has a capacity to supply power of a greater magnitude than a versatile USB, an IEEE1394 compliant connector, and the like.

The interface connector 104 is configured by an interface board 203, the support member 106, etc. together in a unit. In the electronic device 100, the interface board 203 is connected to an expansion bus disposed in the main unit of the electronic device 100, whereby power can be supplied via the interface connector 104.

The support member 106 can be implemented by a planar-shaped substrate of iron, aluminum, etc. The interface connector 104 is attached to the main unit of the electronic device 100, in a state where the interface board 203 is inserted into the casing 101 via a second opening 204 disposed in the casing, and the interface connector 104 and the support member 106 cover the second opening 204. Specifically, for example, the support member 106 is attached to the main unit of the electronic device 100 by screws passing through the support member 106 to be screwed into the casing. The interface connector 104 is attached to the main unit of the electronic device 100 by attaching the support member 106 to the casing 10.

The support member 106 has a shape that extends from the interface connector 104 toward the power source connector 201 so as to cover the second opening 204 as well as cover and hide the power source connector 201 while the support member 106 is attached to the casing 101. Thus, by attaching the support member 106 to the casing 101, the power source connector 201 is covered and hidden, whereby connection of the power source to the power source connector can be prevented when the interface connector 104 is in an attached state.

The support member 106 has a shape enabling plugs to be connected to and disconnected from the communication connectors 102 (102*a*, 102*b*) while the support member 106 is attached to the casing 101. Specifically, the support member 106 has an opening 205 enabling the plug to be connected to and disconnected from the communication connector 102 (102*a*) disposed between the power source connector 201 and the interface connector 104. Consequently, even when the interface connector 104 having the power supply terminal is in a state of being mounted to the electronic device 100, the plug for the communication connector 102 (102*a*) can be connected to the communication connector 102 (102*a*).

Further, the support member 106, along the direction in which the portion (cover unit) from the interface connector 104 toward the power source connector 201 extends, is of a dimension whereby the cover unit does not cover or hide the communication connector 102 (102*b*) located farther from the interface connector 104 than the power source connector 201 is from the interface connector 104. Therefore, even when the interface connector 104 having the power supply terminal is in a state of being mounted to the electronic device 100, the plug for the communication connector 102 (102*b*) can be connected to the communication connector 102 (102*b*).

The support member 106 is not limited to enabling the plug to be connected to and disconnected from the communication connector 102 (102*b*) by setting the dimension along the direction in which the cover unit extends. For example, the support member 106 may be of a dimension whereby the cover unit covers and hides the communication connector 102 (102*b*) located farther from the interface connector 104 than the power source connector 201 is from the interface connector 104, and has the opening 205 enabling the plug to be connected to and disconnected from the interface connector 102 (102*a*) disposed between the power source connector 201 and the interface connector 104 and an opening (not depicted) similar to the opening 205.

An indicator may be provided on the support member 106 to indicate the communication connector 102 in a state where the support member 106 is attached to the casing 101. Although not depicted, such indicators can, for example, provide information identifying the plug type compatible with each communication interface. Alternatively, for example, the indicators may be the names of external apparatuses respectively connected to the communication interfaces.

The indicators may be graphics, marks etc. By providing indicators on the support member 106, even if the area around the communication connectors 102 (102*a*, 102*b*) is blocked or hidden, impediment of the functioning of the electronic device 100 can be controlled and the respective plugs for the communication connectors 102 (102*a*, 102*b*) can be easily and assuredly connected to the communication connectors 102 (102*a*, 102*b*).

Figure 4:
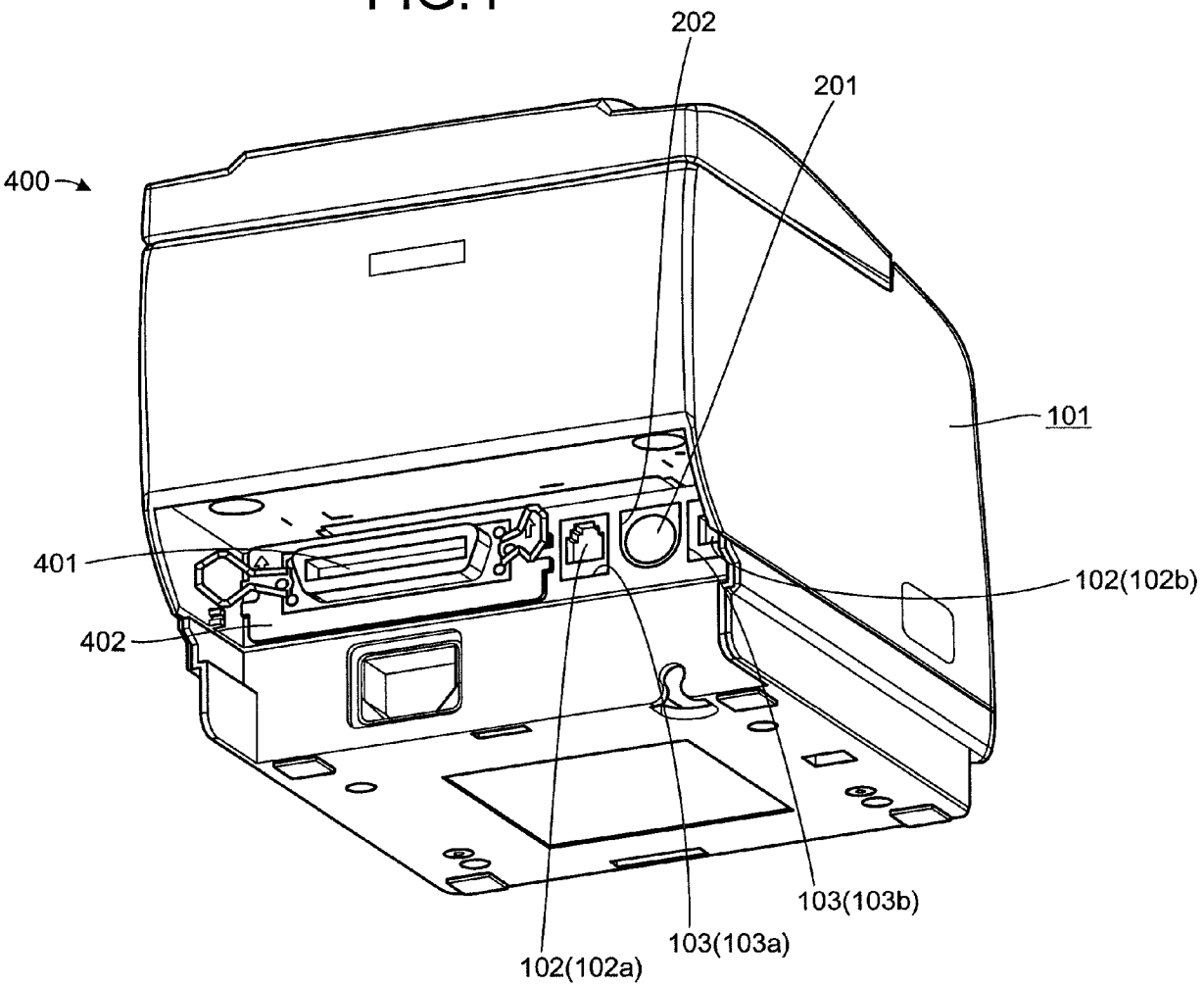
FIGS. 4 and 5 are schematics depicting a configuration of a conventional electronic device.
Figure 5:
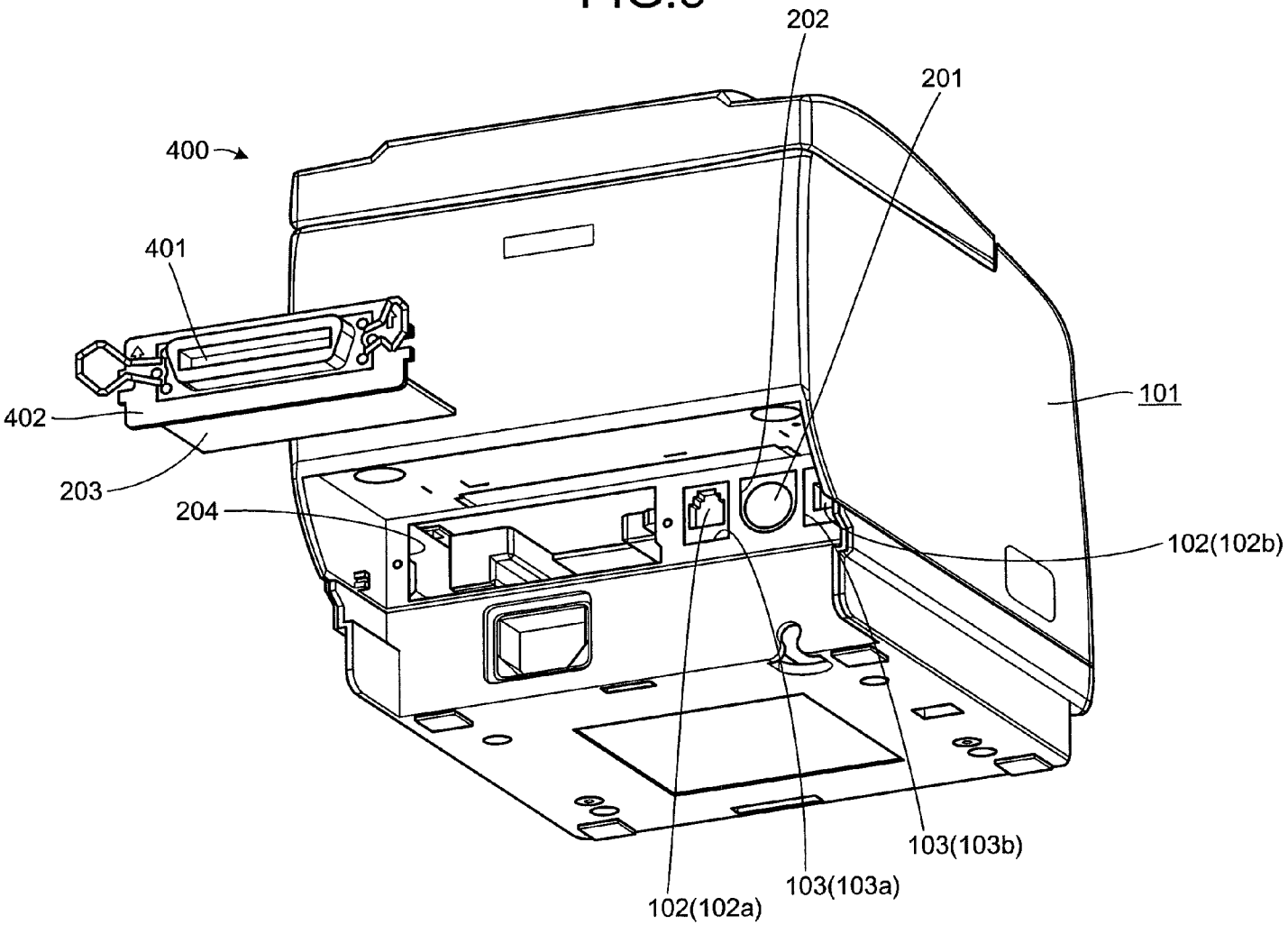

FIGS. 4 and 5 are schematics depicting a configuration of a conventional electronic device. FIGS. 4 and 5 are perspective views of a conventional electronic device 400 as viewed from a lower aspect. For components similar to those of the electronic device 100, description will be given using the same reference numerals used with respect to the electronic device 100. Further, the conventional electronic device depicted in FIGS. 4 and 5 includes an interface connector (a versatile USB, an IEEE1394 compliant connector, and the like) that is detachable from the main unit of the electronic device.

Since a versatile USB, an IEEE1394 compliant connector, and the like can be substituted with the interface connector 104 that is a connector compliant with PoweredUSB standards, with respect to FIGS. 4 and 5, an example of a conventional electronic device to which a versatile USB, an IEEE1394 compliant connector, and the like is attached will be described.

As depicted in FIGS. 4 and 5, an interface connector 401 constituting the conventional electronic device 400 is supported by a support member 402. The support member 402 is formed by a planar-shaped substrate of a size equivalent to that of the second opening 204. Therefore, by attaching the support member 402 to the casing 101 and attaching the interface connector 402 to the main unit of the electronic device, the second opening 204 can be covered and hidden by the support member 402.

If the support member 402 is attached to the casing 101 and the interface connector 401 is attached to the main unit of the electronic device, the conventional electronic device 400 is in a state where the respective plugs for the communication connectors 102 (102*a*, 102*b*) and the power source connector 201 can be connected to the communication connectors 102 (102*a*, 102*b*) and the power source connector 201, identical to the state before the attachment of the interface connector 401.

Therefore, with the conventional electronic device 400, in a state where the plug for the interface connector 401 is connected to the interface connector 401, the power supply plug can be connected to the power source connector 201. The interface connector 401 can be substituted with the interface connector 104, which is a connector compliant with PoweredUSB standards. Therefore, if the configuration of the conventional electronic device 400 is adopted, the power supply plug can be connected to the power source connector 201 in a state where the plug for the interface connector 401 is connected to the interface connector 401.

Consequently, in the conventional electronic device 400, if the power supply plug is connected to the power source connector 201 while the interface connector, which is a connector compliant with PoweredUSB standards, is connected to the interface connector 104, power is supplied to the electronic device 400 by 2 systems. When power is supplied to the electronic device 400 by 2 systems, if the magnitude of the power supplied by the 2 systems is different, the supply direction of the power can reverse back to either of the systems.

Further, if power is supplied to the electronic device 400 by 2 systems and the supply direction of the power supplied from the system via the interface connector 104 reverses, the excess power flows back to the external apparatus connected via the interface connector 104 and data stored in the external apparatus, apparatuses connected to the external apparatus or the apparatus itself is may be damaged.

On the contrary, with the electronic device 100 according to the embodiment, in a state where the interface connector 104 is mounted to the electronic device 100, the power source connector 201 is covered and hidden by the support member 106. In this state, the power supply plug cannot be connected to the power source connector 201 and therefore, a simultaneous supply of power to the electronic device 100 from the power supply unit and via the interface connector 104 can be prevented.

Further, with the electronic device 100, by mounting the interface connector 104 to the electronic device 100, the power source connector 201 can be covered and hidden, whereby a simultaneous supply of power to the electronic device 100 from the power supply unit and via the interface connector 104 can be prevented.

In the electronic device 100, the cover unit covering and hiding the power source connector 201 is integrated with the support member 106 and consequently, by mounting the interface connector 104 to the electronic device 100, the power source connector 201 is assuredly covered and hidden. Thus, a simultaneous supply of power to the electronic device 100 from the power supply unit and via the interface connector 104 can be prevented.

As described, the electronic device 100 according to the embodiment includes the first opening 202 disposed in the casing 101, the power source connector 201 disposed opposing the first opening 202, and the power source connector 201 to which the plug that supplies power from the power supply unit can be connected and disconnected. Further, the electronic device 100 has a configuration that includes the second opening 204 disposed in the casing 101, where among various types interface connectors for communication with an external apparatus, at least one, the interface connector 104, can be attached and detached via the support member 106. Among the various types of interface connectors, if the interface connector 104 having a power supply terminal is attached, the support member 106 covers and hides the power source connector 201.

According to the electronic device 100, by mounting to the electronic device 100, the interface connector 104 having a power supply terminal, the power source connector 201 can be covered and hidden by the support member 106. Consequently, in a state where the interface connector 104 having the power supply terminal is mounted to the electronic device 100, the power supply plug cannot be connected to the power source connector 201. Therefore, a simultaneous supply of power to the electronic device 100 from the power supply unit and via the interface connector 104 can be assuredly and easily prevented.

Further, according to the electronic device 100, the interface connector 104 having the power supply terminal is a connector compliant with PoweredUSB standards. Moreover, in systems where electrical devices are connected to an external apparatus, for the electronic device 100, since power cords strictly for power supply are not used, power can be supplied from the external apparatus to the electrical device through a USB cable, which is sufficiently capable of coping with supply power. As a result, power cords are not necessary and insufficiencies in power supply do not occur, facilitating an improved degree of freedom in the installation of electrical devices.

As described, the electronic device according to the present invention is applicable to electronic apparatus having multiple power supply systems and in particular, is suitable for electronic devices to which third and subsequent power supply systems could be added.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An electronic device comprising:

a first opening disposed in a casing;

a power source connector disposed opposing the first opening and to which a detachable power supply plug that supplies power from a power supply unit is attached;

a second opening disposed in the casing; and a support member by which at least one interface connector among various types of interface connectors for communication with an external apparatus can be attached at the second opening, wherein the support member covers and hides the power source connector when an interface connector having a power supply terminal is attached.

2. The electronic device according to claim 1, wherein the interface connector having a power supply terminal is a connector compliant with PoweredUSB standards.

* * * * *